US005592848A

United States Patent [19]

Bodnar

[11] Patent Number: 5,592,848

[45] **Date of Patent: *Jan. 14, 1997**

[54] METHOD OF SIMULTANEOUSLY FORMING A PAIR OF SHEET METAL STRUCTURAL MEMBERS

[76] Inventor: Ernest R. Bodnar, 2 Danrose Crescent, Don Mills, Ontario, Canada, M3B 3N5

[ * ] Notice: The term of this patent shall not extend beyond the expiration date of Pat. No. 5,207,045.

[21] Appl. No.: 435,426

[22] Filed: May 10, 1995

Related U.S. Application Data

[63] Continuation-in-part of Ser. No. 285,738, Aug. 4, 1994, which is a continuation-in-part of Ser. No. 974,508, Nov. 12, 1992, abandoned, which is a continuation-in-part of Ser. No. 710,524, Jun. 3, 1991, Pat. No. 5,207,045.

[51] Int. Cl.[6] ..... B21D 31/00

[52] U.S. Cl. ..... 72/379.2; 72/185; 72/331; 72/335; 29/415; 29/897.3

[58] Field of Search ..... 29/412, 415, 897.3, 29/897.31; 72/335, 379.2, 331, 337, 185; 52/634, 635, 636, 691, 694, 729.1, 729.5

[56] References Cited

U.S. PATENT DOCUMENTS

| | | | |
|---|---|---|---|
| 1,182,147 | 5/1916 | Dake | 52/630 |
| 1,516,480 | 11/1924 | Whittemore . | |
| 1,698,081 | 1/1929 | Biaker | 52/635 |
| 1,741,423 | 12/1929 | Lachman | 52/636 |
| 1,799,337 | 4/1931 | Warhus . | |
| 1,865,059 | 1/1932 | Piccirilli | 52/729 |
| 1,994,716 | 3/1935 | Klemperer | 52/634 |
| 2,088,781 | 8/1937 | Folsom | 52/634 |
| 2,180,317 | 11/1939 | Davis | 52/588 |
| 3,342,007 | 9/1967 | Merson | 52/729 |
| 3,381,439 | 5/1968 | Thulin . | |
| 3,530,631 | 9/1970 | Guddal | 52/414 |
| 4,486,994 | 12/1984 | Fisher et al. | 52/309.4 |
| 4,490,007 | 12/1984 | Murata . | |
| 4,602,467 | 7/1986 | Schilger . | |
| 4,732,028 | 3/1988 | Bodnar . | |
| 4,793,113 | 12/1988 | Bodnar . | |
| 4,909,007 | 3/1990 | Bodnar . | |
| 5,207,045 | 5/1993 | Bodnar | 52/729.1 |

FOREIGN PATENT DOCUMENTS

| | | | |
|---|---|---|---|
| 1264957 | 1/1990 | Canada . | |
| 4262802 | 9/1992 | Japan | 72/185 |
| 1158714 | 5/1985 | U.S.S.R. | 52/694 |
| 1231170 | 5/1986 | U.S.S.R. | 52/694 |

*Primary Examiner*—Daniel C. Crane
*Assistant Examiner*—Ed Tolan
*Attorney, Agent, or Firm*—Foley & Lardner; Jon Carl Gealow

[57] ABSTRACT

A method of forming a pair of sheet metal structural members simultaneously from a single elongated strip of sheet metal defining parallel side edges and comprising the steps of severing the strip sheet metal along a predetermined zig-zag separation path, thereby dividing the strip into two strip portions on opposite sides of the zig-zag separation path, each having generally zig-zag edges the zig-zag edges being in generally inter-fitting relation; forming edge flange formations along the zig-zag edges of each of the strip portions at an angle thereto, and, forming linear edge formations along the parallel side edges of the strip portions.

4 Claims, 10 Drawing Sheets

METHOD OF SIMULTANEOUSLY FORMING A PAIR OF SHEET METAL STRUCTURAL MEMBERS

This application is a Continuation-in-Part of U.S. patent application Ser. No. 08/285,738 filed Aug. 4, 1994, entitled Sheet Metal Structural Member, Construction Panel and Method of Construction, inventor Ernest R. Bodnar, which is in turn a Continuation-in-Part of U.S. patent application Ser. No. 07/974,508, filed Nov. 12 1992, entitled Sheet Metal Structural Member Construction Panel, and Method of Construction, Inventor Ernest R. Bodnar, now abandoned, which was in turn a Continuation-in-Part of U.S. patent application Ser. No. 07/710,524 filed Jun. 3 1991 entitled Sheet Metal Structural Member Construction Panel and Method Construction inventor Ernest R. Bodnar issued under U.S. Pat No. 5,207,045 dated May 4 1993.

FIELD OF THE INVENTION

The invention relates to a method of simultaneously forming a pair of sheet metal structural members from a single elongated strip of sheet metal.

BACKGROUND OF THE INVENTION

Structural metal members of a wide variety are known, but in the great majority of cases, they cannot be conveniently formed of sheet metal using high speed cold rolling and forming equipment. In the past, generally speaking, metal members for carrying structural loads have been formed, usually by welding heavy sections together, or by cutting and welding, or in other cases by rivetting, or other fastening methods. All of these manufacturing methods are relatively slow. In addition, the material used in these members with heavy gauge material. Generally speaking, for carrying lighter structural loads, wood was the preferred material. Clearly it is advantageous to make lighter metal structural members both of heavier gauge and of lighter gauge, out of sheet metal material. This enables such members to be made in a wide variety of sizes and specifications, using high speed cold roll forming and bending techniques.

An example of such a cold rolled sheet metal structural member is shown in U.S. Pat. No. 4,793,113 & 4,490,007.

One particularly advantageous use for such sheet metal structural members is in the fabrication of thin shell concrete precast panels, although this is not exclusive, and many other uses and applications exist, for such members.

Numerous proposals have been made for the fabrication of precast panels for use in the construction of buildings. Such precast panels are attractive in that they enable the walls of a building to be covered in a more economical manner, and in a shorter space of time than with conventional wall coverings such as bricks, stone, and the like.

In addition, precast panels enable buildings to be covered in with a wide variety of different decorative surfaces and decorative effects moulded into the precast panels.

In addition, since the precast panels can be prefabricated away from the building site, preferably at, for example, a factory, factory labour can be used usually at higher production rates and at lower wage rates than on-site construction labour. In addition, a greater accuracy is possible in the production of such panels, so that the end result in the finished building is both aesthetically pleasing, and is also efficient and effective.

One of the most popular forms of precast panel is a solid panel of concrete, into which is embedded one or more layers of reinforcing steel mesh. Usually such precast panels are at least three inches or more in thickness.

Such panels are of extreme weight. In addition, they have a very low R value. That is to say, the thermal insulation offered by a precast concrete panel is very small. Variations in exterior temperature are rapidly transmitted through to the interior of the building.

Consequently, in this form of construction using precast concrete panels, the panels are customarily supported on the building fabric, which may be either concrete columns, or steel columns, and then interior walls complete with insulation will usually be installed, so as to provide a stable controllable climate within the building.

In addition, because of the extreme weight of the panels, the anchoring system whereby they are anchored to the building must be very carefully designed to withstand all possible stresses due to climate, length of time of use, and also, if erected in earthquake zones, they must be capable of withstanding a certain degree of seismic shock.

All of these factors are very well known and understood by construction engineers generally.

Notwithstanding the obvious disadvantages of such solid precast panels however, they have remained in general use for very many years, in spite of numerous attempts to replace them with a more economical alternative.

For example, there is disclosed in U.S. Pat. No. 4,602,467, dated Jul. 19, 1986, inventor H. Schilder, a form of precast concrete panel, which is reinforced with simple generally C-shaped channel sections of steel. Edge portions of the C sections are formed in various different ways for embedment in the concrete. Using this system, it is said that a substantial reduction in the thickness of the concrete is possible. A similar system is illustrated in Canadian Letters Patent 1,264,957. The steel C sections are said to add rigidity to the thin shell of concrete which forms the exterior panel.

Using this type of system, buildings were in fact constructed, in which the building thermal insulation was placed between these steel C sections. The interior wall surface of the building, typically being some form of dry wall panels, was attached directly to the interior edges of the steel C sections.

Numerous examples of earlier similar proposals are illustrated in the art, listed in that U.S. patent.

There are however numerous problems resulting from the use of this type of proposal.

In the first place, concrete and steel have differential rates of expansion and contraction. Consequently, when exposed to extremes of heat and cold the steel will tend to extend or contract along its length, a distance greater than that of the concrete. Consequently, over time, there will be a gradual working or movement between the steel and the concrete, which may loosen the bond between the steel and the concrete.

An additional problem is the fact that in such earlier proposals, the edge portion of the steel which was embedded in the concrete, constituted a "break line" extending, usually vertically, along the panel at spaced intervals. Bearing in mind that it was intended with this type of thin shell panel to reduce the concrete thickness to less than two inches and, in some cases, one and a half inches was mentioned, the existence of such a continuous break line at regular intervals across the panel constituted possible fracture lines if the panels were exposed to unusual shocks.

While these particular disadvantages and hazards might not arise with any great frequency, a much more serious problem was the problem of heat transfer. The sheet metal reinforcement C section members, being embedded in the relatively thin exterior concrete panel of the building, acted as ideal heat transfer bridges transferring heat one way or the other depending upon the season, through the wall.

This was particularly noticeable in the colder seasons. In these seasons, when the ambient air outside the building is cold, and the interior of the building is heated, heat is transferred out through the wall, along the line of each of the C sections. This lost heat creates cold zones in the interior walls, along the lines of the channels. These cold zones, in turn, result in lines of condensation of moisture, which condenses out of the air and settles on the walls. The effect is generally known in the construction industry as "ghosting" on the walls, and is regarded as unacceptable under almost all building codes.

As a result, when using this system it is generally necessary to place a layer of insulation over the C sections, or some other form of thermal break was built into the construction of the wall, so that the interior wall of dry wall panels or the like, was kept completely out of contact with the C sections. However, this greatly increased the cost of the construction system, and as a result, tended to discourage builders from using the system.

One greatly improved form of construction panel overcoming a number of these problems is shown in U.S. Pat. No. 4,909,007, dated March 1990, inventor Ernest R. Bodnar.

In that Patent, there is disclosed a precast panel, reinforced with sheet metal stud members. The stud members are formed with diagonal struts at spaced intervals defining openings therebetween. In this way, the heat transfer bridge is reduced, leading to a reduced heat transfer path, and reducing if not completely eliminating the ghosting problem.

In the system, it was possible to attach the interior dry wall panels directly to the stud-members, thereby reducing the overall cost of the building system.

An additional advantage of this system was the fact that the edge portion of the stud which was formed to be embedded in the concrete was formed either as bent over tabs or as pierced holes, so that some of the concrete in the panel could flow through the holes or around the tabs, thereby reducing the degree of weakening of the stud. In addition, problems caused by differential rates of expansion and contraction were also reduced.

However, the stud disclosed in that patent involves the production of a stud with a relatively high degree of wastage of steel, caused by the cutting out of portions of the sheet metal between the struts. In addition, even though the embedded edge portion of the stud was formed with holes, portions of it were still continuous, and caused, to a minor degree, some of the problems encountered and described above.

The invention described below is not however restricted exclusively to use in the fabrication of this shell concrete precast panels. The invention provides sheet metal structural members having numerous advantages in a variety of different situations, other than when used in association with precast concrete, and the invention is not to be regarded as restricted solely to the use of such studs in combination with precast concrete to form pin shell panels.

BRIEF SUMMARY OF THE INVENTION

With a view to overcoming the various disadvantages noted above, the invention comprises a sheet metal structural member comprising; a sheet metal web lying in a predetermined plane and defining a generally linear edge portion along one side, and a generally zig-zag edge portion along the other side, said zig-zag edge portion defining wider regions each having an apex, and narrower root regions between said wider regions, and said web extending in a generally zig-zag fashion from one said narrower region through said wider region to the next said narrower region; edge flange formations formed around said zig-zag edge portions of said web and extending at an angle to said predetermined plane, recess means formed in each of said wider portions of said web, said recess means extending generally from an apex of a said web to a root region of said web; flange means formed around each of said recess means, whereby to reinforce said web, and, generally triangular indentations formed in said root of said web adjacent said recess means, but spaced therefrom, said triangular indentations being defined by a first generally linear base side, parallel to said linear edge portion of said sheet metal web, a second side, extending from said base side as an angle, and a third generally curved side extending from said base side, said sides meeting one another at generally curved junctions, and said second and third side defining on either side thereof root portion of said web, located between said edge flange said triangular recess means.

The invention further comprises such a structural member and including attachment means at the apex of each of said wider portions of said web, whereby said attachment means may be secured to a construction material.

The invention further comprises such a structural of the member, and wherein attachment means are in the form of embedment formations formed at the apex of each of the wider portions of the web, and wherein the embedment formations may be embedded in a cast material for reinforcement of the same, said cast material being free of attachment to said web between said embedment formations.

The invention further comprises such a structural member and wherein a reinforcement tubular portion is formed along said linear edge portion, said tubular portion being formed by folding over a portion of said web on itself to enclose an elongated tubular regular cross section, and including means joining the free edge of the said web to an intermediate portion of said web to enclose said tubular portion.

The invention further comprises such a structural member wherein opening means are formed through said web between said narrower regions, thereby forming said web in the area of the said wider regions into two generally diagonal strut portions meeting at said apex of said wider portions.

The invention further comprises such a structural member wherein said embedment formations comprise opening means form through said web in the region of said apex, and tongue means bent outwardly from said web adjacent said opening means, whereby said tongue means may become embedded in a cast material, and said cast material may flow through said opening means.

The invention further comprises such a structural member and wherein said web in the region of each said apex is coated with a synthetic plastic material, thereby isolating the same from said construction material.

The invention further comprises such a structural member wherein said linear edge defines a generally right angular channel section.

The invention further comprises a structural member of the type described including a continuous attachment strip secured to the apex of each of said wider portions of said web, and extending generally parallel to but spaced from said linear edge of said member, and thermal break means interposed between each said apex and said attachment member.

The invention further comprises a method of constructing a building panel and comprising the steps of assembling a plurality of structural members each of which comprises a sheet metal web defining a generally linear edge portion along one side and generally zig-zag edge portion along the other said side said zig-zag edge portion defining wider regions and narrower regions and said web extending in a generally angular fashion from one said narrower region through said wider region to the next said narrower region and defining apexes in said wider region, into a reinforcing frame work, pouring a castable construction material in a form to a predetermined depth, and placing said reinforcing frame work of structural members with said apexes of said webs extending partially into said castable material, permitting said castable material to cure, and removing said composite panel from said form work.

The invention further comprises a method of constructing a level portion of a building and comprising the steps of erecting a plurality of such structural members according to the invention in a generally transverse horizontal fashion as spaced apart intervals, placing form of work between said structural members, supporting said form work by form work support means engaging said structural members, and said form work, while permitting portions of said structural members to extend upwardly above said form work pouring a castable construction material on said form work, and allowing same to flow around said upstanding portions of said webs of said structural members, allowing said castable material to cure, and thereafter removing said form work supports and said form work from the floor thereby forming an integral cast floor slab, together with partially embedded structural members supporting the same.

The invention further comprises a method of forming a pair of said structural members simultaneously from a single elongated strip of sheet metal and comprising the steps of severing said strip sheet metal along a pre-determined zig-zag separation path, dividing said strip into two portions of equal area on opposite sides of said separation path thereby separating said strip into two strip portions each having a generally zig-zag edge formation, said formations being in generally inter-fitting relation, forming edge formations along said zig-zag edges of each of said strip portions, and forming linear edge formations along edges of said strip portions remote from said zig-zag edge formations.

The invention further comprises such a method of and including the steps of punching out openings in each of said strip portions, in wider regions of said web defined by said zig-zag edges thereof, and forming edge formations around said opening.

The invention further comprises such a method and wherein said strip portions define outer edges remote from said zig-zag edges, and including the steps of bending said outer edges into a generally tubular formation, and fastening the free edge of said outer edges to an intermediate portion of each said strip portion, whereby to secure same in its tubular shape.

The invention further comprises such a method and including the step of forming further openings in said wider portions of said zig-zag edges of said strip portion, and bending tongue portions of said web portions outwardly from said further openings.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figures 13A, 13B, 13C:
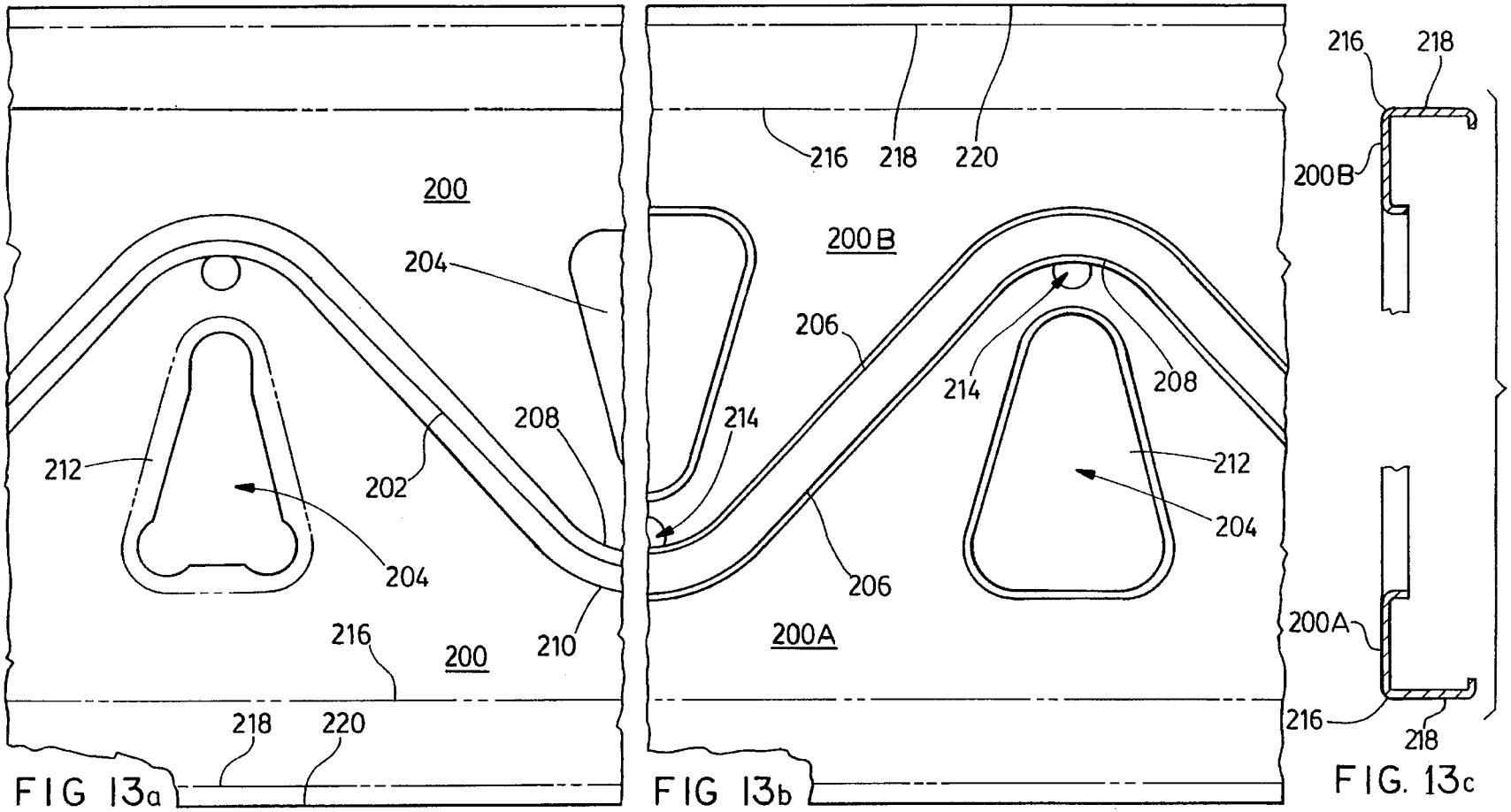

FIG. 13*a* is a top plan view, illustrating a sheet metal blank, at one stage during the formation of a pair of the structural members of the invention;

FIG. 13*b* is a top plan view corresponding to FIG. 13*a* at a later stage in formation of the same pair of structural members;

FIG. 13*c* is a schematic section partially cut away, at a later stage in the formation of the members of FIGS. 13*a* and 13*b*.

Figure 14:
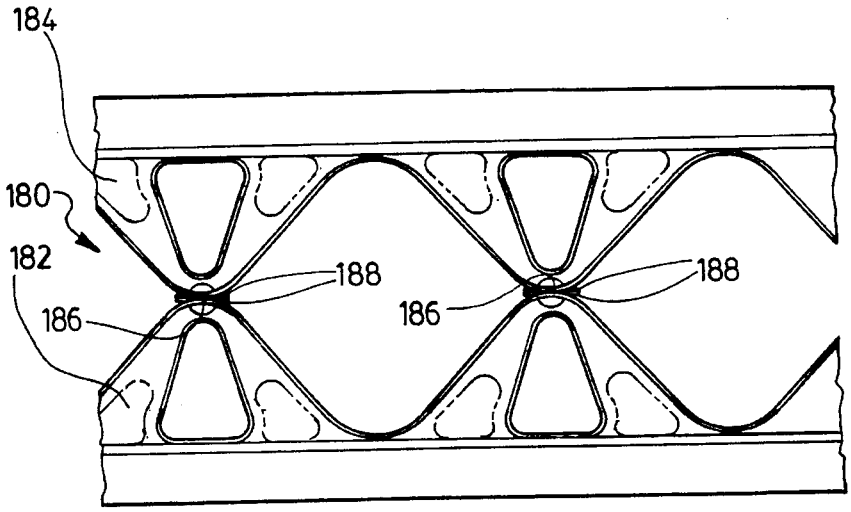
Figure 15:
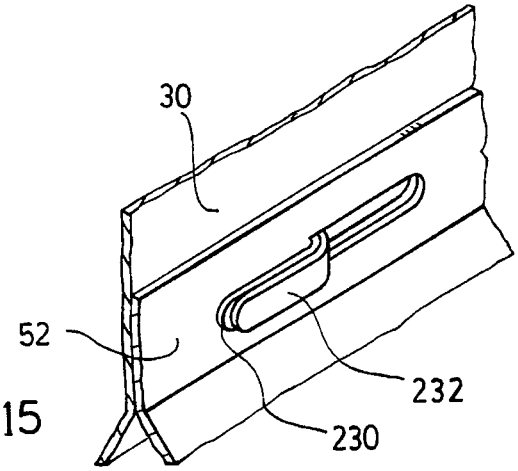
Figure 16A:
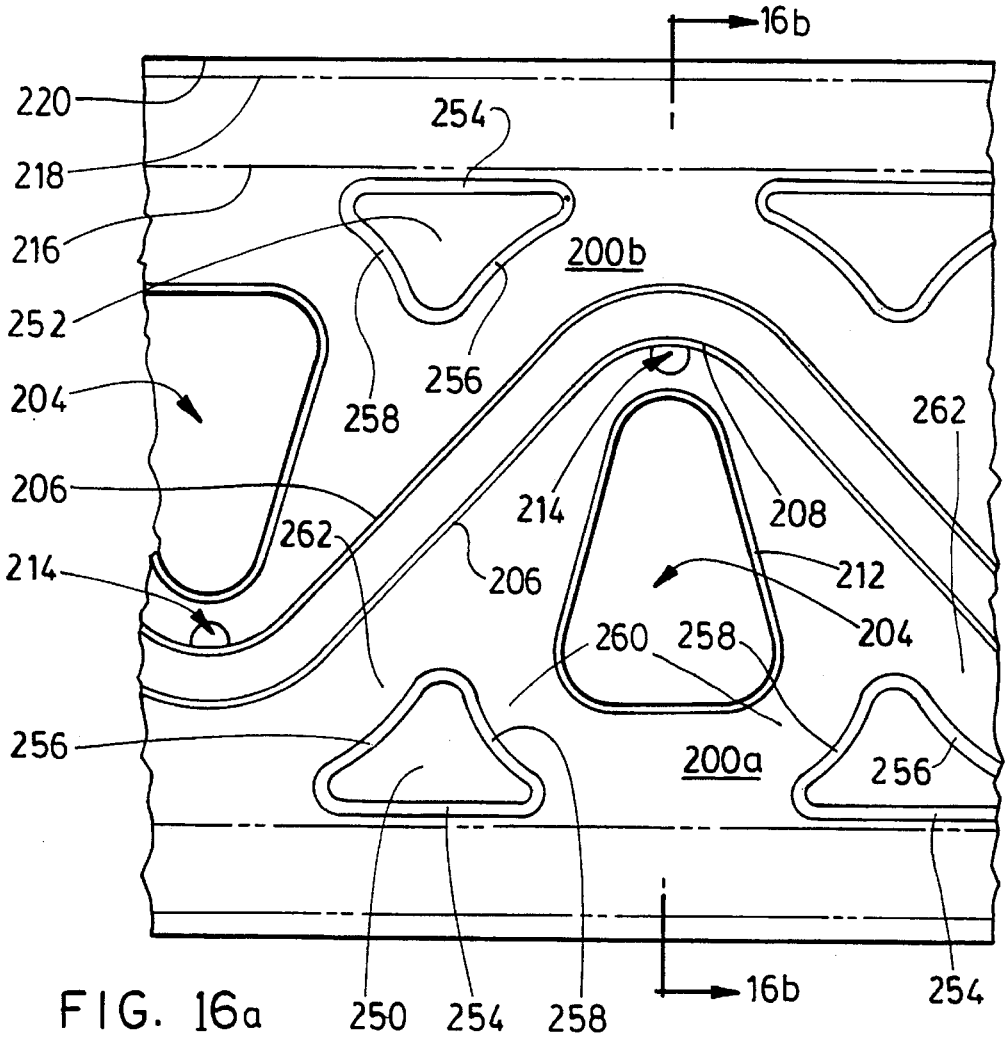
Figure 16B:
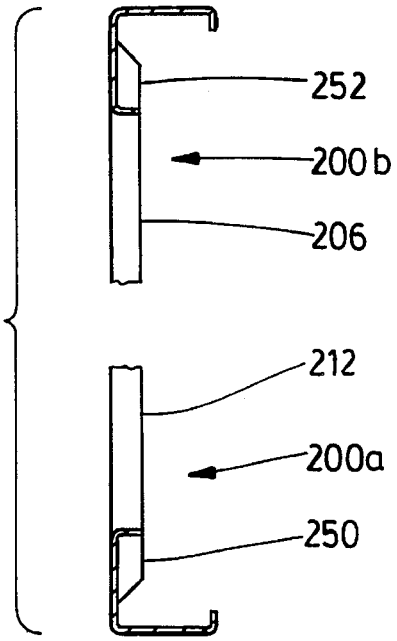
Figure 17B:
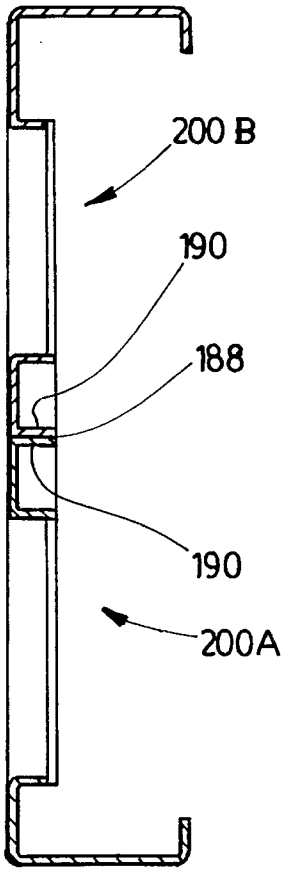
Figure 17A:
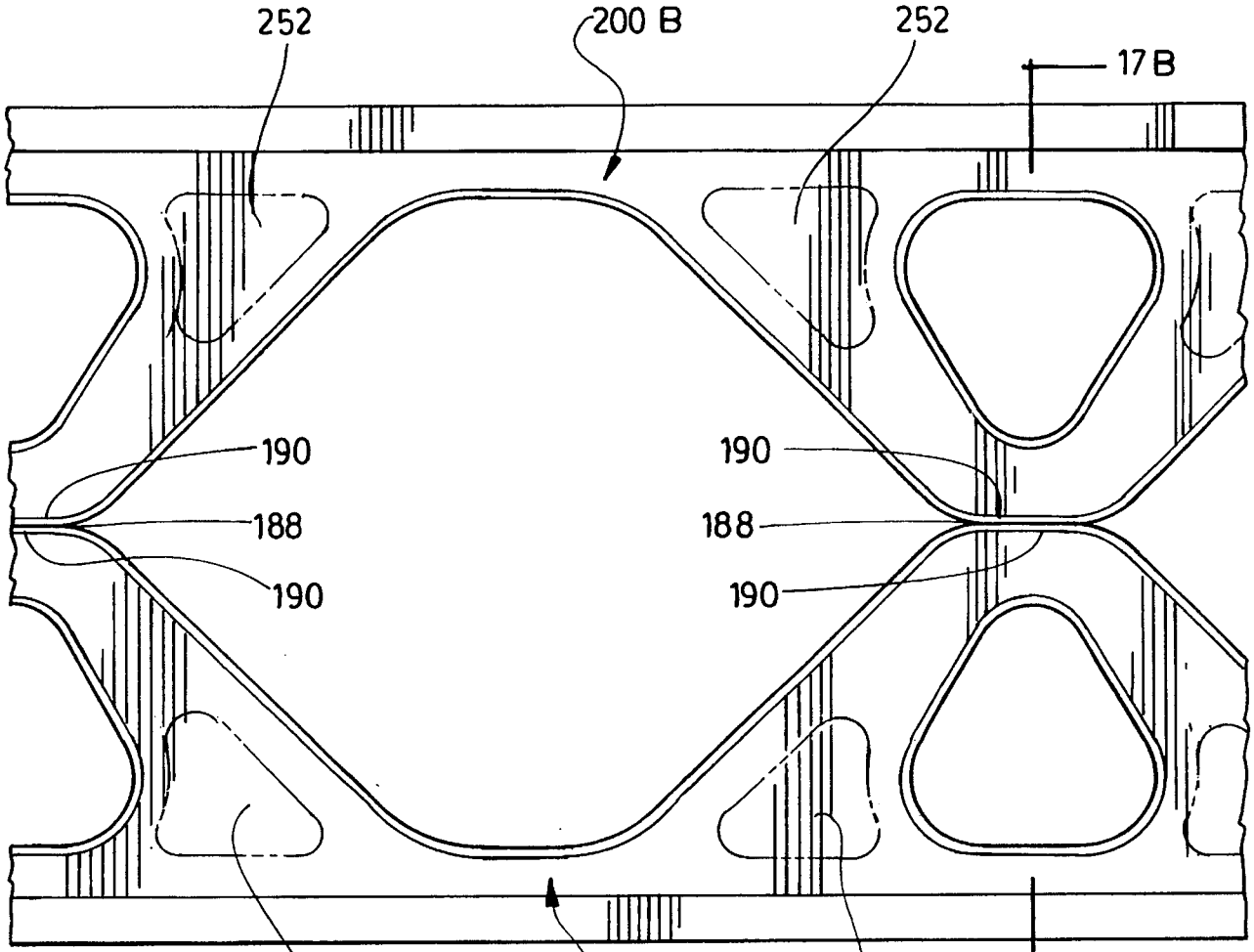

FIG. 14 is a side elevation of a composite beam embodiment formed of two metal members;

FIG. 15 is a perspective showing the attachment of two portions of the member to one another;

FIGS. 16*a* and 16*b* are a side elevation and partial sections of a further feature of the invention, and, FIGS. 17*a* & 17*b* show a modified form of composite metal beam.

DESCRIPTION OF A SPECIFIC EMBODIMENT

Figure 1:
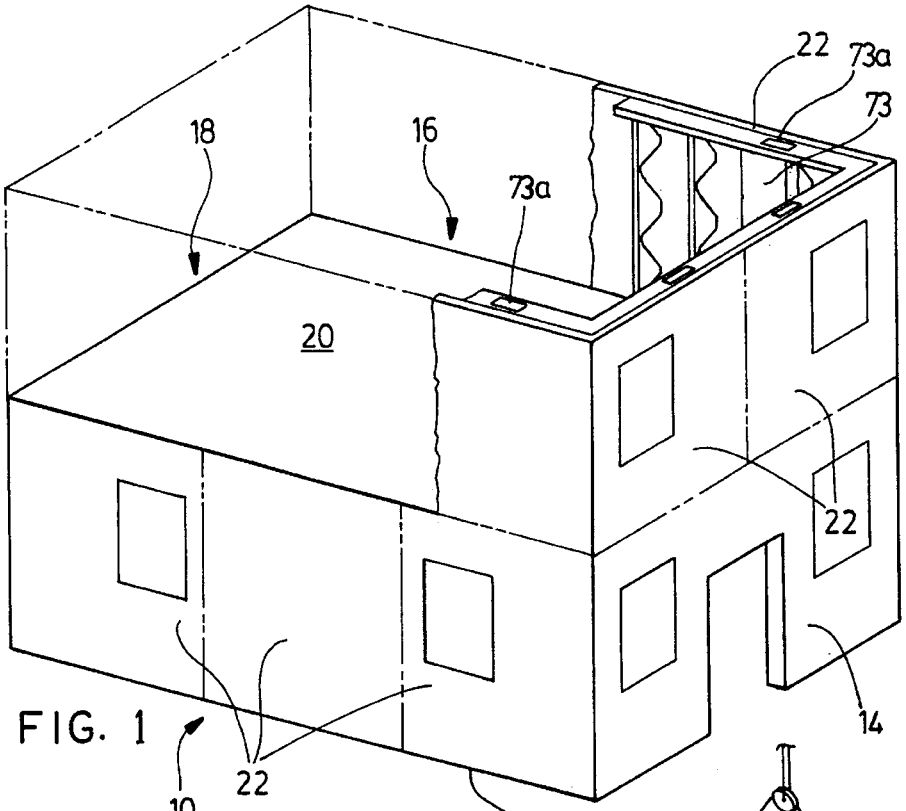
FIG. 1 is a schematic perspective illustration showing a building in a first stage of construction.
Figure 2:
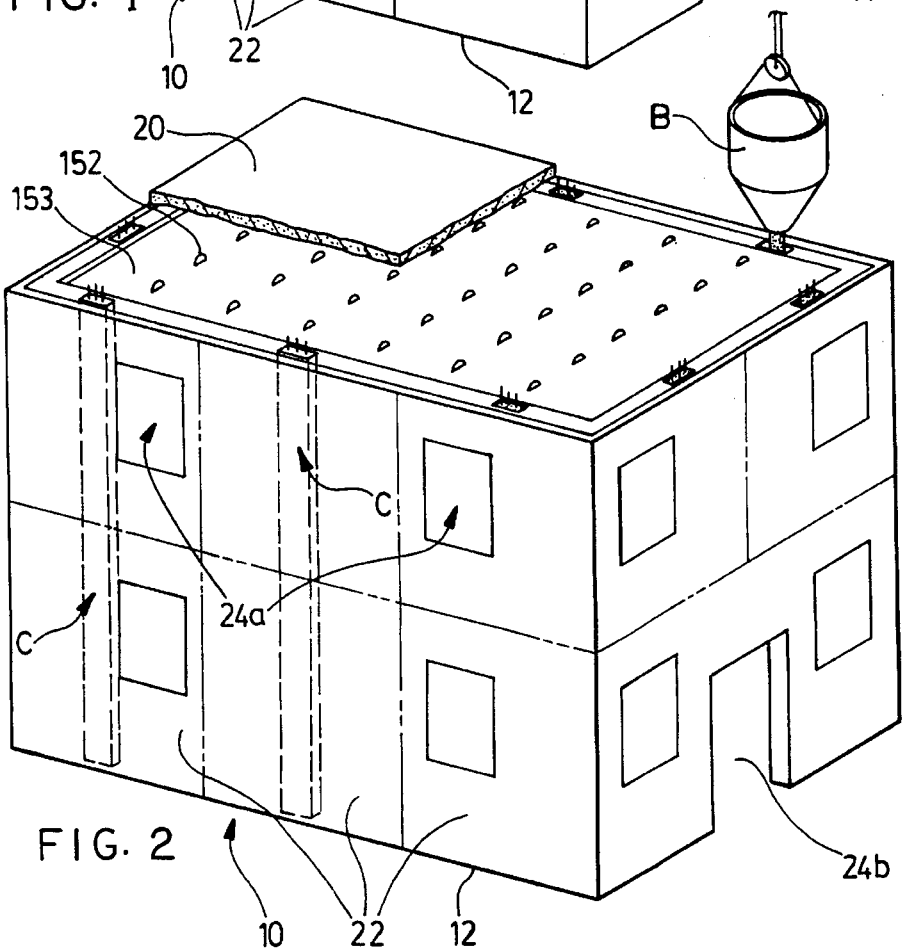
FIG. 2 is a schematic illustration of the same building showing it in a later stage of construction.

Referring first of all to FIGS. 1 and 2, it will be seen that what is represented there in generally schematic form is a typical, relatively simple building under the course of construction. FIG. 1 illustrates the first floor of the building which is illustrated generally as 10, with exterior walls 12, 14, 16, 18, being completed, and with a floor 20 having been poured of concrete.

What is illustrated in FIG. 2, is a partial stage in the construction of the second floor of the building As will be apparent from FIG. 2, the walls 12, 14, 16, 18 of the building are fabricated of composite precast panels which are indicated generally as 22—22 and so on.

While the same reference numeral is indicated generally as representing all such panels, it will be appreciated that the panels may be of different shapes and sizes. Some of the panels may simply define a blank wall surface. Others of the panels may incorporate window openings, such as 24*a*, and others of the panels may incorporate door openings such as 24*b*.

It will also be appreciated that some of the panels, for some buildings, may have an exterior finish (not shown), of any of a variety of materials which may vary from glass, to marble, to simulated brick facing, metal, aggregate surfacing, and even synthetic plastic material, to name only a few of the different surface finishes that may be applied to such panels.

The details of such surface finishes on such panels are well known to persons skilled in the art, and consequently no specific description of such finishes or how they may be applied is required here.

Figure 3:
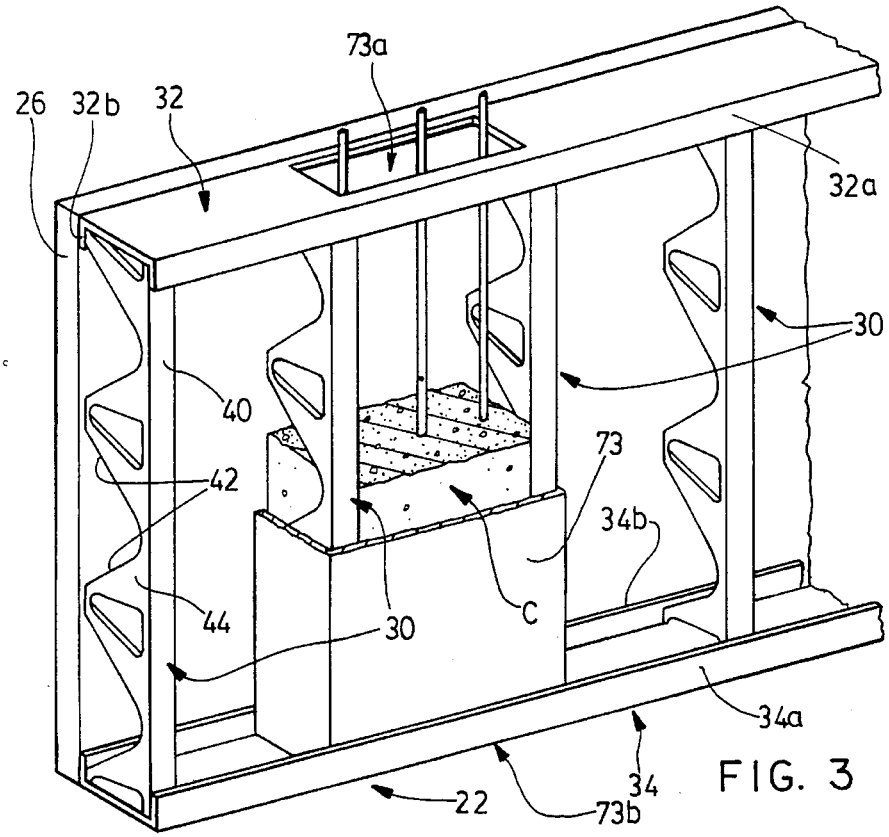
FIG. 3 is a perspective illustration of a typical construction panel incorporating the studs of the invention, partially cut away to reveal its construction.

Referring now to FIG. 3, it will be seen that this represents a typical panel 22. The panel 22 will be seen to be comprised of a continuous layer 26 of a castable, or settable material, in this case concrete, being reinforced by typically a layer of reinforcing mesh 28, such as is well known in the art. Typically the cast material may be anywhere from 1" to 1 ½" or 2" in thickness, and will in any event be much less than the thickness of an equivalent layer of plain pre-cast concrete material, such as is known in the prior art.

Layer 26 is further reinforced by a plurality of spaced apart steel studs 30. Typically the steel studs 30 will be spaced apart on for example 24" centres, although in some cases 16" centres may be required. Nothing turns on the specific spacing, except that it should be suitable for the building requirements of the building under construction.

In addition to the vertical studs 30, transverse horizontal top and bottom plate members 32 and 34 are provided, to provide a complete reinforcing framework for each of the panels. The plates 32 and 34 may be made of the same stud as the studs 30 themselves or may be made of different shapes and sections of material if required.

In the case of FIG. 3, plates 32 and 34 are illustrated in the form of simple channel sections having web portions 32A, 34*a* and edge wall portions 32*b*, 34*b*.

As will become apparent from the following description, the studs 30, and also preferably the plates 32 and 34 are all formed of sheet metal, being advantageously formed by cold roll forming techniques, which provide for high production rates and consistent quality, in a highly advantageous manner.

Figure 5:
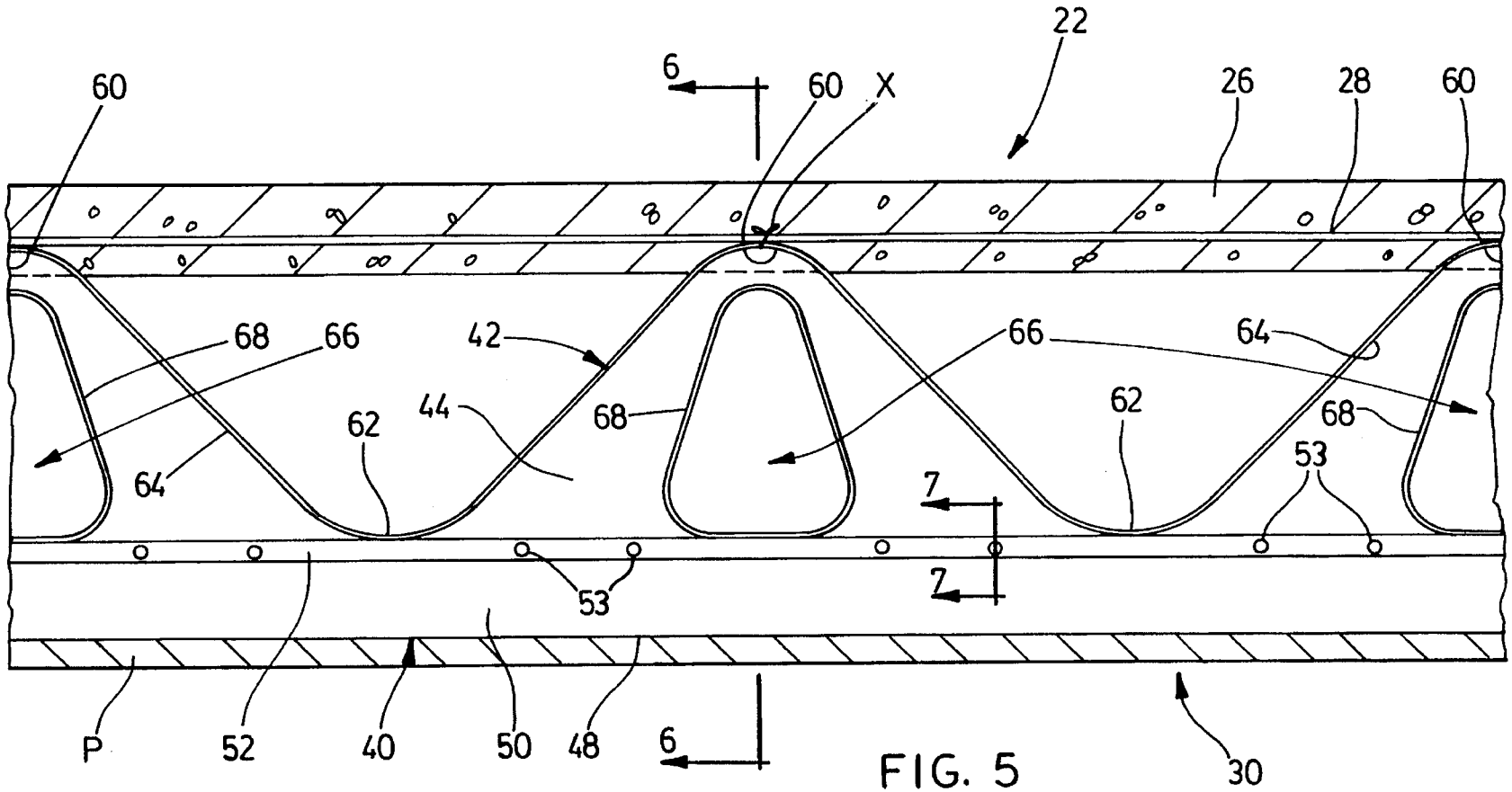
FIG. 5 is a section along the line 5—5 of the panel of FIG. 4.
Figure 6:
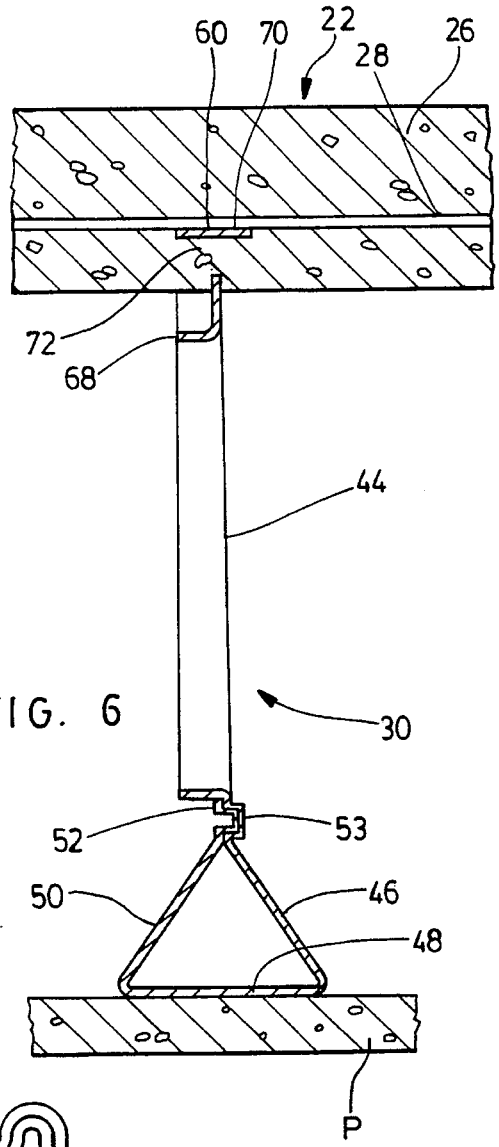
FIG. 6 is a section along the line 6—6 of FIG. 5.
Figure 7:
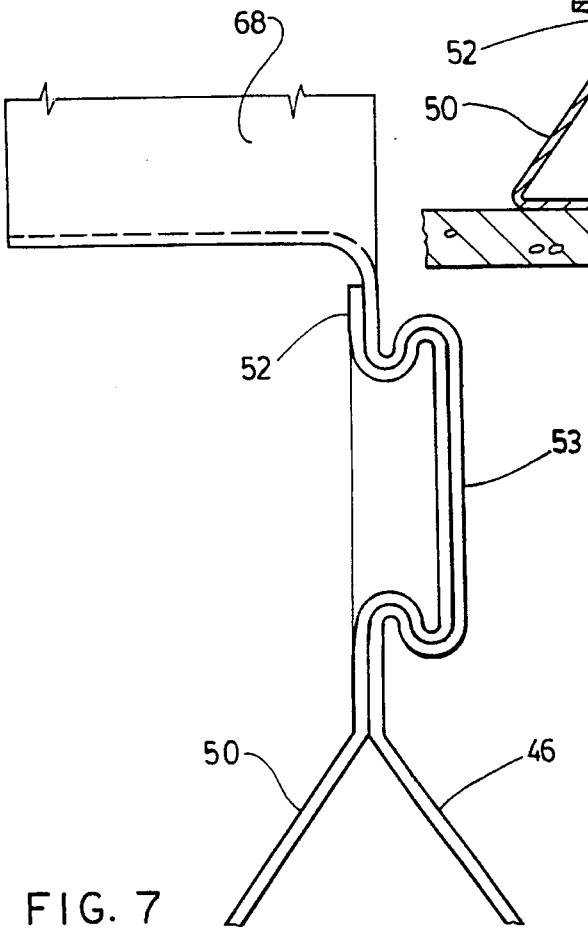
FIG. 7 is an enlarged section along the line 7—7 of FIG. 5.

Reference now may be made to FIGS. 5,6 and 7 wherein the construction of the stud 30 is illustrated in more detail.

The stud 30 will be seen to comprise a first generally linear edge 40, and a second generally zig zag edge 42. Between the edges 40 and 42, a web 44 of varying width of sheet metal extends from one edge to the other in a generally zig-zag as shown.

The linear edge of the stud may be made in a variety of different shapes, to achieve a variety of different results. In the example shown in the FIGS. 5, 6 and 7, the linear edge 40 of the web is formed into triangular tubular reinforcing flange portions 46, 48 and 50 and an edge flange 52. Edge flange 52 runs parallel to the web, and is secured thereto by any suitable means, for example, by spot welding, or any other suitable means. In the particular example illustrated, the preferred method of attachment is by what is know as "toggle" rivetting as at 53 (FIGS. 5, 6 and 7). In this system, a die is punched into the sheet metal, and the sheet metal is extruded into an oversized die recess, so that a form of "stitching" of the two pieces of sheet metal takes place (see FIG. 7).

This is however merely one of various convenient methods of securing the flange to the web.

It will be observed that in this way a hollow continuous triangular formation is provided having great strength and structural rigidity.

Such a form of structural member or stud may have a substantial load bearing capacity, and may be used for exterior walls up to a considerable number of building stories.

With suitable adjustments in the dimensions, and the gauge of the sheet metal, a similar formation of stud may be used as a joist for supporting flooring, and also a roofing or ceiling structural member can also be made in the same way.

For lighter load bearing capacities, and for interior walls, the triangular formation along the linear edge of the stud will not always be necessary, as will become apparent as following description proceeds.

Thus the studs are of application to a variety of load bearing applications, whether embedded in a cast panel, or used on their own, without cast material.

The web 44 defines generally triangular shapes having apexes 60 at the widest points and throats 62 at the narrowest points. A continuous edge flange 64 is formed along the free edge of the web, which zig zags from apex to throat and back to apex and so on. In the wider portions of the webs, that is to say more or less in registration with the apexes and between any two throats, the web is preferably, although not essentially, formed with a recess or opening 66. Around the edge of the recess or opening an edge flange 68 is formed.

In this way each of the webs is formed into a generally triangular shape having two, more or less diagonal strut-like formations joined integrally at their apexes. The "thermal" bridge effect of the web is reduced to the extent that metal is removed at such openings, and by the extended diagonal length of the strut formations.

Figure 8:
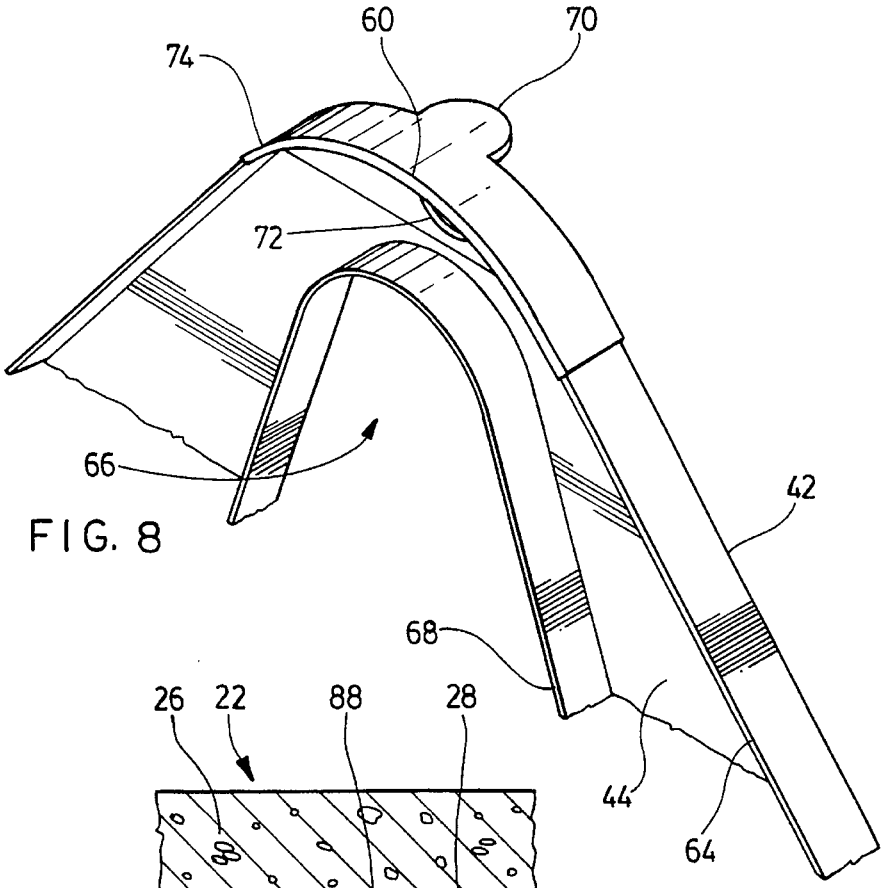
FIG. 8 is an enlarged partially cut away perspective illustration of a portion of the structural member.

From FIG. 5, 6 and 8 it will be observed that each of the apexes of the webs is formed with a struck out tongue 70, leaving an opening 72 forming an attachment means for the cast panel extending therethrough at the apex. Preferably each tongue 70 is struck out to one side of the web, opposite to the side on which the edge flange 64 extends from the web.

In this way, the tongues 70 and flanges 64 extending on opposite sides of the web, provide for panel attachment means having particular advantages described below.

When incorporated for the purposes of reinforcing a thin panel of concrete as shown in FIG. 5, the apexes are embedded into one side of the concrete layer, to a depth sufficient to cover the openings 72 formed at the apexes of the webs, typically up to about ¾", in the case of a 1 ½" panel.

In this way each apex of each web is securely embedded in the material and the material flows around the attachment means comprising the flange 64 of the web on one side, and around the tongue 70 struck out from the web on the other side, and through the opening 72 thereby forming a good secure bond around the apex portion of each web.

In between the apexes however it will be noted that the studs are free of attachment to the cast panel.

Consequently, differences in the rates of expansion and contraction between the sheet metal and the cast material will have little if any effect on the security of the attachment of the cast material to the studs.

It will of course be appreciated that once fabricated, the panels in accordance with the invention may readily be attached to a building framework which may be made up of concrete or structural steel columns, to form the exterior walls on such a framework. In addition, such panels may be used to form interior walls if desired.

Such panels may be cast with a variety of exterior finishes and surface effects and detailings and mouldings all such as is well known in the art.

It will also be appreciated that the studs, being located typically on 24" centres forming part of an integral generally rectangular frame work (FIG. 3) provide an excellent secure method of securing the panels in position on the building, while permitting a minimum of thermal transfer through from the interior to the exterior. At the same time, expansion and contraction of the steel relative to the concrete panels due to thermal forces, has a negligible effect upon the security of the embedment of the apex portions of the webs in the panels.

Typically, building panels will be fabricated in a factory, away from the building site. Typically a generally horizontal form (not shown) is laid on a horizontal surface. Concrete or other castable building material is poured into the form, with or without an exterior surface finish having been first of all applied to the bottom of the form. The rectangular frame work of studs and plates as shown in FIG. 3 will have been assembled elsewhere in the plant. Typically the network of reinforcing rods 28 may be simply tied or fastened to the webs by wire ties (FIG. 5).

The assembly of the stud frame work and reinforcing rods is then lowered down into the form, and is allowed to sink into the concrete to a depth equal to usually about a ½ or somewhat less than the thickness of the panel being poured. The material is then allowed to cure after which it is removed from the form.

It will of course be appreciated that in some cases it may be desirable to insulate and pre-finish the walls in the factory. This can simply be achieved by placing insulation material (not shown) between the studs, and then by securing interior wall panelling such as dry wall panels p (FIG. 5) to the linear edges of the webs.

In addition, where the panels incorporate window openings, the windows closing in those openings can also be installed in the factory prior to shipment to the building site.

It will be appreciated that the overall weight of each panel in accordance with the invention is substantially less than the overall weight of a typical solid precast concrete panel. Consequently, a larger number of panels of the invention can be shipped on a given method of transport. Typically this will be a flat bed tractor/trailer, so that the shipping and trucking costs of the panels will be substantially reduced.

In addition, since the panel weight is much less than that of conventional solid panels, the footings and specifications of the building itself may also be substantially reduced, or the floor loadings increased. Conversely, for a given building design, it may be possible to erect several more stories, using the panels in accordance with the invention, since the overall total weight of the structure will be less than using solid concrete.

In addition, the handling of the panels in accordance with the invention is much easier, since the handling equipment such as cranes and the like will not be required to handle such heavy loads as in the case of solid precast concrete. It will be observed that since the thermal bridge effect of the studs in accordance with the invention is minimized, and that where dry wall is applied to the interior or linear edges of the studs, heat transfer will be minimized, and ghosting will be substantially eliminated, without the need for special additional insulation being applied to the stud surfaces at the interior of the building, as was the case in the past.

In accordance with a particularly advantageous feature of the invention, the spaces between any two vertical studs in a panel may if desired, be used for pouring vertical columns for supporting the building structure. Such columns are indicated generally as C in FIG. 2.

In order to form such columns C, formwork panels 73 (FIG. 3) may be attached to any adjacent pair of studs 30.

Openings 73*a* and 73*b* are formed in the upper and lower plates 32–34 respectively in registration with the space between the selected pair of studs 30. Reinforcing steel rods are will be incorporated between the two studs 30 in a manner well known in the art.

When such form work panels are assembled in this way and placed in a building structure under construction (FIG. 2) the columns may simply be poured in place by for example for use of a typical concrete pouring bucket.

When the next story of panels is erected, similar formwork 73 and openings 73*a–b* will of course register with the columns in the lower panel, so that the columns supporting the building will be continuously poured, from floor to floor, at the same time as the walls are placed in position, and at the same time as the floor 20 is also being poured.

As a result the entire building is poured in a series of floors, each floor, and its associated columns, forming a continuous homogenous structure throughout each story of the building, from one floor through the panels in accordance with the invention, to the next floor and so on.

The formwork 73 may be removed after suitable curing time has elapsed. Alternatively, in some places the formwork may simply comprise a portion of an interior wall finish, and be left in position.

It is also be apparent to those skilled in the construction industry that if desired, the columns C could be poured in place in the wall panels 22, while the wall panels 22 were actually being poured and cured in their horizontal framework. In other words both the wall panels and the columns could be precast in a factory remote from the building site.

It is a simple matter to erect the wall panels 22, in position, and secure the bottom of each of the precast columns to the floor 20, and pouring the next floor 20 after erection of joists and formwork for pouring the flooring of the next floor of the building, as will be described below.

In accordance with a further advantageous feature of the invention the apexes 60 of the webs may be coated with or dipped in any suitable synthetic plastic material. Typically this will be an epoxy based material, and the coating or dipping will be applied as shown by the coating layer 74 in FIG. 8. The effect of applying this coating layer at this point is twofold.

In the first place, it provides a further thermal barrier to the transfer of heat between the concrete panel itself and the reinforcing studs. In addition however it provides an additional coating on the studs. Studs for the purpose of reinforcing concrete panels of this type are almost always made of galvanised sheet metal, so as to resist corrosion. However, as is well known such galvanising is not always a permanent solution to the problem of corrosion.

In accordance with the invention, by the coating of the apexes of the studs with the coating layer 74, the sheet metal of the studs is substantially completely isolated from the concrete, and consequently corrosion due to moisture or other chemical contents in the concrete, or other cast material where other materials are used, will be substantially eliminated.

It will be apparent from the foregoing description that studs, joists and other structural members, may be made in accordance with the invention in a variety of shapes and for a variety of specifications and purposes whether incorporated in cast panels, or used on their own.

Figure 9:
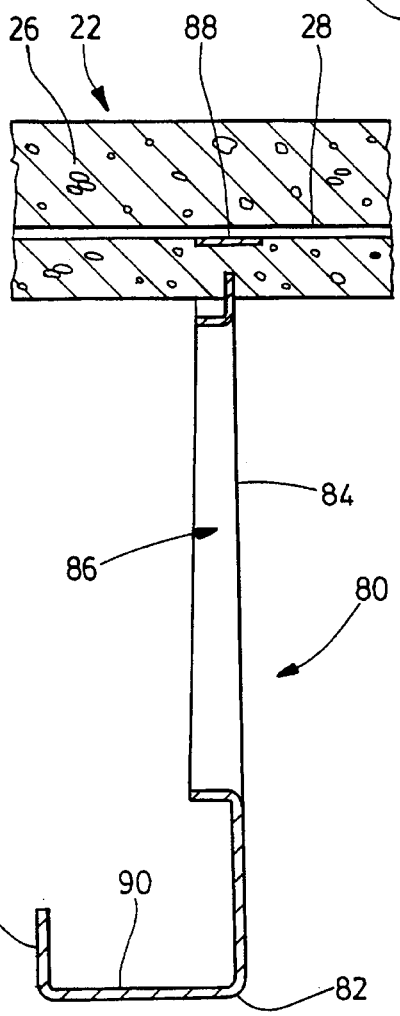
FIG. 9 is a section corresponding to FIG. 6, illustrating a further embodiment of structural member.

FIG. 9 illustrates a lighter duty form of stud indicated generally has 80. Such a stud 80 has a linear edge 82 and a web 84 formed with openings 86 therethrough.

Apexes 88 of the stud 80 are provided, substantially same as in the case of the stud of FIG. 5.

However, the linear edge 82 of the stud is provided with a simple C-section, comprising the facing flange portion 90 and the return reinforcing flange 92.

While such studs will not have so great a load bearing capacity as the stud illustrated in FIG. 5, they may be used in many cases for exterior wall panelling where the exterior wall panelling is not required to carry a substantial loads. In addition, they may be used for interior walls and building partitions.

Figure 10:
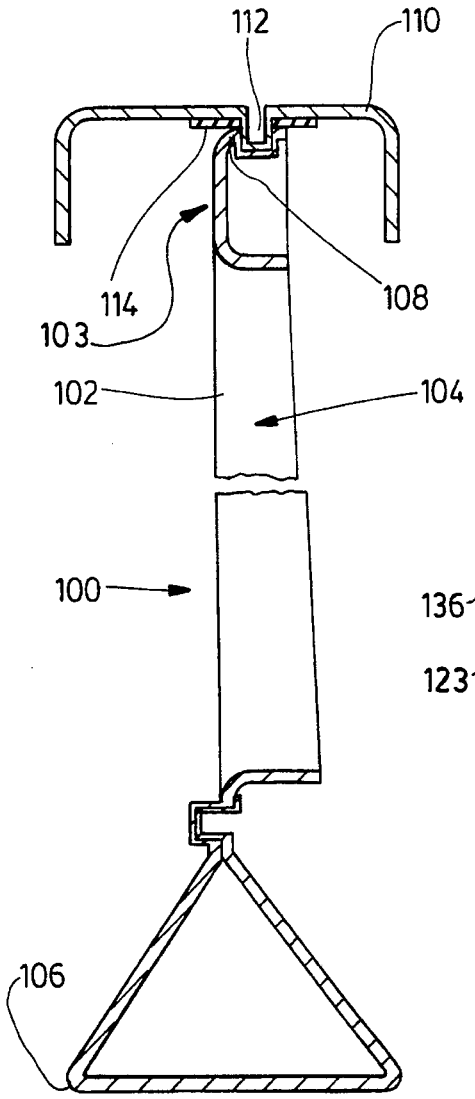
FIG. 10 is a section corresponding to FIG. 9, showing a further form of structural member.

In FIG. 10 a further form of stud is illustrated. In this case, the stud illustrated generally as 100 has a web portion 102 with a zig-zag edge 103 and formed with openings 104 therethrough. A linear edge 106 is formed into a triangular tubular formation as in the case of FIG. 5. Apexes 108 are formed on the web.

However, in order to provide an alternate form of attachment, a continuous channel 110 is secured along the apexes of the web, being fastened thereto for example by "toggle" fastenings 112. In order to provide a thermal break, a layer of synthetic plastic material 114 is provided between the apexes, and the channel 110.

Figure 11:
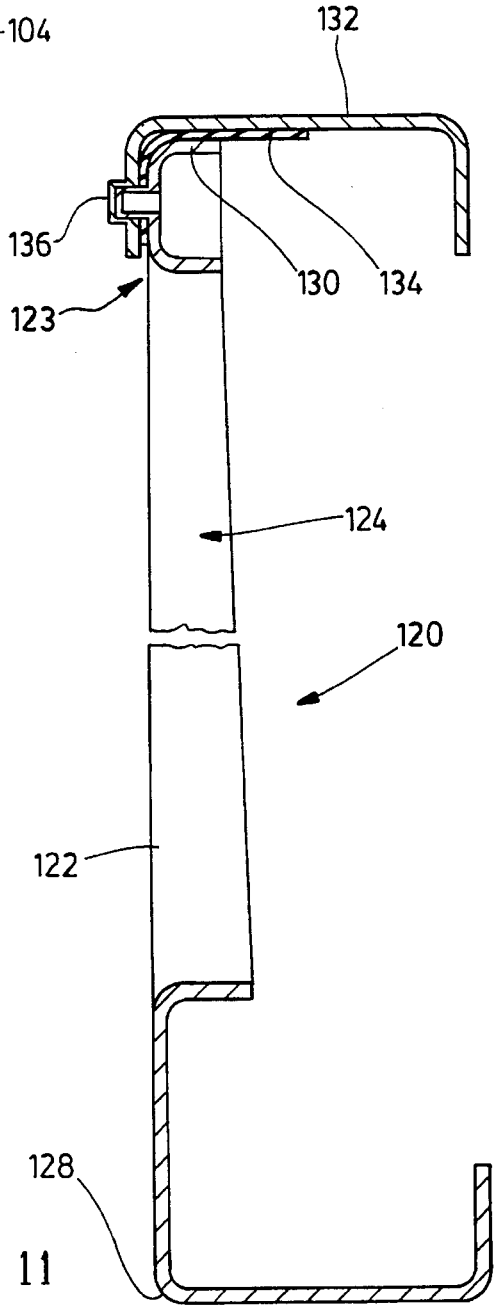
FIG. 11 is a section corresponding to FIG. 9, showing a further form of structural member.

FIG. 11 illustrates a still further form of stud 120. In this case a web 122 has a zig-zag edge 123 and is formed with openings 124 and linear edge 128, and having apexes 130. The linear edge 128 is formed in a generally C section, similar to that of FIG. 9. A channel 132 is secured to the apexes 130 of the webs. A thermal break is provided by means of a plastic panel 134. The channel 132 is secured to the apexes of the webs by means such as "toggle" stitching 136.

It will be appreciated that with the variety of different sections illustrated, it is possible to design and fabricate a steel stud for constructing load bearing walls and for constructing light weight wall panels, and it is also possible to increase the specifications of the studs so as to provide load bearing joists and other heavy duty structural steel members for flooring, roofing and the like in all forms of construction.

Figure 12:
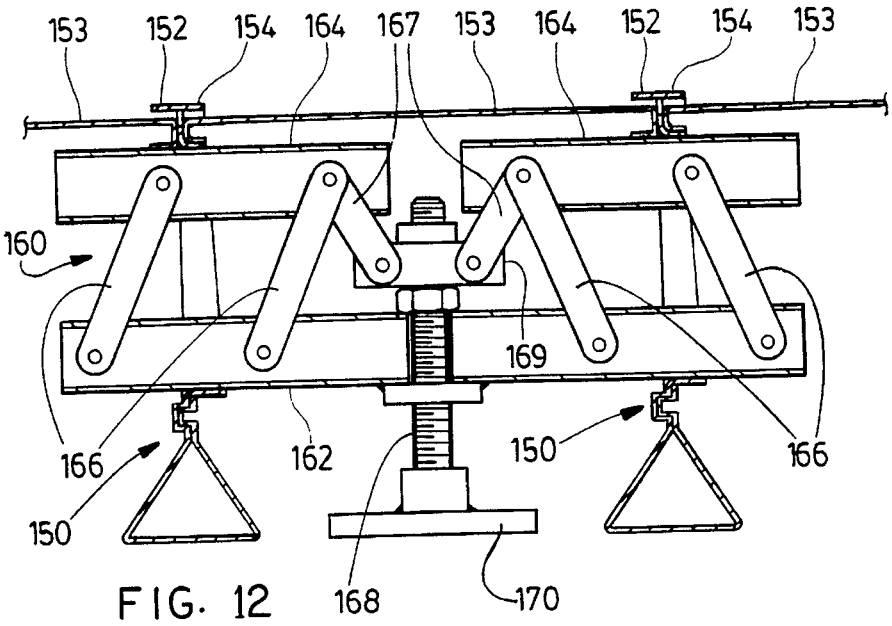
FIG. 12 is a section corresponding to FIG. 6, showing the use of concrete form work, and a formwork retention device.

Thus, for example the structural members of the invention, as is shown in FIG. 12 may be used as joists 150—150 for the supporting of a floor. A floor is to be poured out of concrete material, and for this purpose horizontal form work is required, as is well known in the art. In accordance with the invention, the joists 150 are fabricated in this particular embodiment in the manner shown in FIGS. 5, 6 and 8. However, the specifications of the gauge of the sheet metal, and the dimensions of the webs will be suitably adjusted, so as to have the appropriate load bearing capacity for the span of floor being erected.

It will be appreciated from FIG. 12, that the joists 150 in accordance with the invention having apexes 152 may be embedded in the floor, which is poured in place in the building, so as to provide a completely seamless one piece integral floor, with its own embedded joists supported in a highly advantageous and economical manner.

For this purpose, the joists are supported across the building at appropriate centres, typically being 24" centres or whatever spacing may be required for that particular building. Form work panels 153 are then placed between the joists, spaced somewhat below the apexes 152 of the joists, and their corresponding tongues 154.

In order to support the formwork at this level, a system of form work clamps 160 is provided. The clamps 160 consist essentially of a lower bar member 162, and a pair of upper bar members 164—164. Links 167 connect the upper bar members with the lower bar member. Scissors links 166 connect the bars 164, with an operating screw 168 and nut 169. By means of a hand wheel 170, or other suitable formation, the screw can be rotated, thereby forcing the scissors linkage outwardly and upwardly. This in turn will cause the links 166 to swing upwardly, thereby moving the upper clamping bars relative to the lower bar. In this way, the formwork panels can be supported at the desired level, leaving apex portions 152 of the webs extending upwardly above the level of the form work panels 153.

Figure 4:
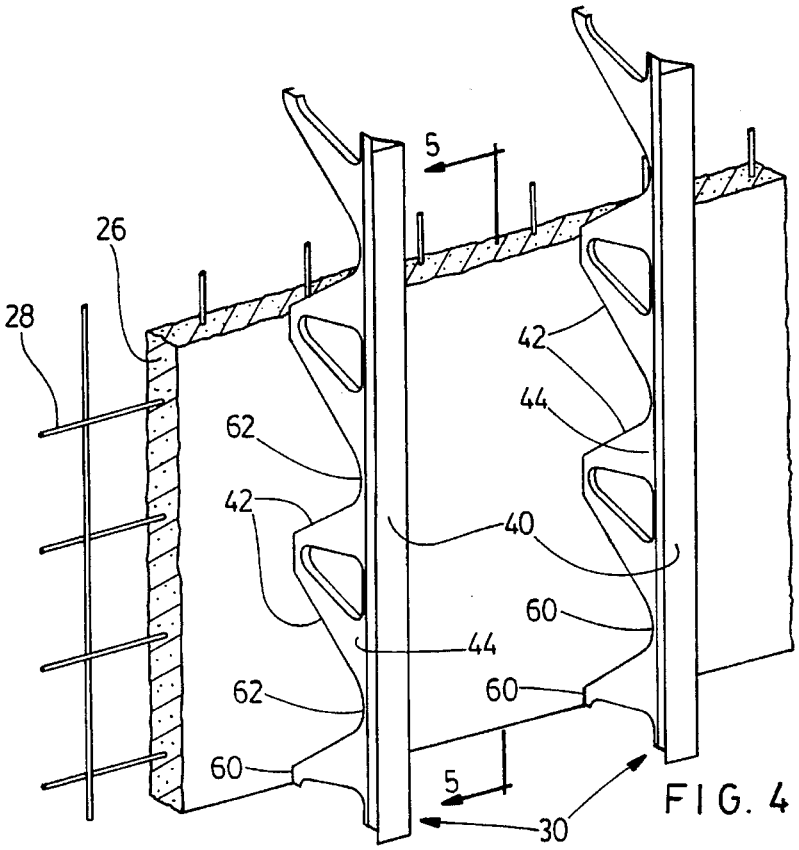
FIG. 4 is a greatly enlarged perspective illustration of a portion of FIG. 3.

When the concrete is then poured on the form work panels, it will flow around the apexes of the webs, essentially in the same way as described in connection with the panels of FIGS. 3 and 4.

The floor is then allowed to cure, leaving a solid integral one piece structure.

The formwork may then simply removed by releasing the screws and removing the clamps and form work from underneath the floor, or may be left in place in some cases.

This is in fact what is illustrated in schematic form in FIG. 2, wherein a portion of the floor 20 is indicated as having been poured and, portions of form work, with apex portions 152 of the webs of the joists 150 extending upwardly therefrom are generally illustrated.

It will of course be appreciated that the scale and relative sizes of various components in FIG. 2 has been somewhat altered for the sake of illustration only, simply for the purposes of explanation of the principle of the invention.

It will be appreciated that in accordance with the invention two such structural members may be associated together to make a single composite structural member having a greater rigidity and load bearing capacity. Such a composite structural member is illustrated in FIGS. 14 and 17*a–b* by the reference 180.

It will be seen to comprise a first structural member 182 and a second structural member 184.

Further, the two structural members 182 and 184 are placed with the apexes 186, 186 of the webs in registration with and actually in contact with one another. The apexes are then fastened or secured together in any suitable manner for example, by spot welding 188 or the like.

Preferably, in order to provide a secure solid attachment, the apexes 186 are formed with flattened regions 190 (FIGS. 17*a*–17*b*), to provide for a high degree of integrity and strength at the junction between the two structural members.

Such composite structural members will have unique properties in that they are fabricated at low cost from sheet metal, and yet have high strength and great load bearing capacity relative to the weight of metal in a given length of structural member. In addition, the cost of fabricating such composite structural members is considerably less than the cost of constructing structural members having an equivalent strength, using conventional techniques.

Also illustrated in phantom in FIGS. 14 and 17*a*–17*b* are the generally triangular depressions 250, 252, described in detail in connection with FIG. 16*a*–16*b*.

In accordance with a further highly advantageous feature of the invention, the structural members of the invention will preferably be formed by cold rolling and cold forming techniques, as illustrated generally in FIGS. 13*a*, 13*b* and 13*c*. Essentially, in accordance with the practice of the invention it is possible to form two separate structural members out of a single continuous strip of sheet metal. This greatly reduces the wastage of sheet metal which was inherent in open work structural members such as are shown in U.S. Pat. No. 4,909,007 referred to above. As shown in FIG. 13*a*, a strip 200 of sheet metal, particularly although not exclusively being galvanized steel of a suitable gauge, is passed along a cold forming line, during which passage the strip 200 is severed along the zig-zag partition line 202. Preferably in order to form webs with openings such as shown in example FIG. 5, openings 204 are formed through the webs during the continuous cold forming process.

At a subsequent stage in the cold forming process as shown in FIG. 13*b* edge flange formations 206 are formed along the zig-zag edges of the two strip portions 200*a* and 200*b*. These will form the edge flange formations on the eventual structural members already described above.

It will be noted that the line of the partition 202 is closer to the edge of the flange 206 at the apex 208 of each web and, is furthest from the flange at the throat 210 of each web.

In this way the edge flanges 206—206 which are formed along the zig-zag edge of each of the two strip portions 200 *a*, 200*b* varies from a minimum width at the apex 208 to a maximum width at throat 210. This provides valuable additional strength to the structural member in areas where it is required.

Similar edge flanges 212 are formed around openings 204, and are bent outwardly therefrom at the same stage in the operation.

Openings 214 are formed at the apex 208 at each of the webs, and the material struck out from the openings 214 is used to form the tongues illustrated in the structural member for example in FIG. 5.

Along both sides of the strip 200, edge flange bends are formed, to form first edge flange formations. Further edge flange bends 218—218 are formed spaced from the bends 216, and parallel to them (See FIG. 13*c*). The linear strip is defined by its two free edges 220—220

In this way a continuous generally C-section linear edge flange formation is provided along the edges of both studs simultaneously similar to the embodiment illustrated in FIG. 9. The pair of studs thus formed are illustrated in elevation in FIG. 13*c*.

These steps are of course carried out by continuous roller die stands which are located on the cold forming line downstream from the severing portions of the line, so that the severing of and edge-forming of the zig-zag edge and the forming of openings takes place first, after which the linear edge flange formations are then bent progressively by longitudinal roll forming in well known manner.

The continuous zig-zag severing, and punching of openings, may be performed by machinery illustrated in U.S. Pat. No. 4,732,028 dated Mar. 22, 1988 Inventor Ernest R. Bodnar, which machinery is particularly suitable for the cold forming of sheet metal to sever the same and to form flange formations therein in a continuous non-stop operation.

Accordingly, such machinery is not illustrated herein, since it is already illustrated in sufficient detail in the aforesaid patent.

FIG. 15 shows an alternate mode of securing the free edge of the linear flanges, to the intermediate portion of the web. In this case, tongues 230, 232 are punched out of both the free edge of the web, and of the intermediate portion respectively. The tongues are bent over as shown with tongue 232 passing through the opening formed by tongue 230 to secure the two web portions together with a tongue 232 passing through the opening formed by tongue 230.

FIGS. 16*a* and 16*b*, show a further feature of the invention. In this feature, generally triangular indentations indicated generally as 250 and 252 are formed in the webs 200*a*, 200*b* adjacent the base of each of the diagonal strut portions, defined by the generally triangular recesses 204—204. Such triangular depressions have a linear base side edge 254, parallel to the edges 216 of the webs. The triangular depressions have second and third sides 256, 258.

The second sides 256 may be linear, or may be slightly curved. The first second and third sides meet at rounded corners.

The curvature of the third side 258 of each triangular depression will generally complement the curvature of the adjacent corner of the triangular recess. In this way this the curvature of the third side 258, and the curvature of the adjacent corner of the triangular recess define a generally arcuate strut root portion 260. The second side 256 and the adjacent side of the adjacent triangular recess, form a further strut root portion 262.

In this way greatly increased rigidity is added to the web.

It will be still further appreciated that while in this description reference has been made to triangular openings, with central portions of metal removed, and with edge flanges formed there around, there may be some circumstances where the saving in metal and saving in weight, and reduced thermal transmission, are not so material. In these cases, the generally triangular openings 204, may simply be formed as triangular recesses or depressions, without removing the metal therefrom. This may in fact provide a marginally even stronger metal member which may be desirable for some purposes.

The term "triangular openings" as used herein is therefore deemed to include both "openings" and "recesses" where no metal has been removed, but is simply displaced.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A method of forming a pair of sheet metal structural members simultaneously from a single elongated strip of sheet metal defining parallel side edges and comprising the steps of;

severing said strip sheet metal along a pre-determined zig-zag separation path, thereby dividing said strip into two strip portions on opposite sides of said zig-zag separation path, each having generally zig-zag edges said zig-zag edges being in generally inter-fitting relation;

forming edge flange formations along said zig-zag edges of each of said strip portions at an angle thereto, and, forming linear edge formations along said parallel side edges of said strip portions.

2. A method as claimed in claim 1 and including the steps of forming recess means in each of said strip portions, in wider regions, defined by said zig-zag edges thereof, and forming edge flanges around said recess means.

3. A method as claimed in claim 2 and wherein said strip portions define outer edges remote from said zig-zag edges, and including the steps of bending said outer edges into a generally tubular formation, and fastening each said outer edge to an intermediate portion of each said strip portion, whereby to secure same in a tubular shape.

4. A method as claimed in claim 2 including the step of forming opening means in said wider portions of said zig-zag edges of said strip portions, and bending tongue portions of said strip portions outwardly from said opening means.

* * * * *